US012185843B2

(12) United States Patent
Yuan et al.

(10) Patent No.: US 12,185,843 B2
(45) Date of Patent: Jan. 7, 2025

(54) FOLDING CHAIR

(71) Applicant: WITH-U E-COMMERCE (SHANGHAI) CO., LTD., Shanghai (CN)

(72) Inventors: Chunliang Yuan, Shanghai (CN); Shengyong Yang, Shanghai (CN)

(73) Assignee: WITH-U E-COMMERCE (SHANGHAI) CO., LTD., Shanghai (CN)

( * ) Notice: Subject to any disclaimer, the term of this patent is extended or adjusted under 35 U.S.C. 154(b) by 148 days.

(21) Appl. No.: 18/107,116

(22) Filed: Feb. 8, 2023

(65) Prior Publication Data

US 2024/0138571 A1 May 2, 2024

Related U.S. Application Data

(63) Continuation of application No. PCT/CN2022/143145, filed on Dec. 29, 2022.

(30) Foreign Application Priority Data

Oct. 27, 2022 (CN) ..... 202222837038.7

(51) Int. Cl.
*A47C 4/28* (2006.01)

(52) U.S. Cl.
CPC ..... *A47C 4/286* (2013.01)

(58) Field of Classification Search
CPC ..... A47C 4/286
See application file for complete search history.

(56) References Cited

U.S. PATENT DOCUMENTS

2002/0117878 A1* 8/2002 Fox ..... A47C 4/286 297/16.2
2011/0156449 A1* 6/2011 Obolewicz ..... A47C 4/286 297/16.2
2023/0200539 A1* 6/2023 Chen ..... A47C 4/286 297/47
2023/0371693 A1* 11/2023 Kim ..... A47C 4/286

FOREIGN PATENT DOCUMENTS

CN 217137286 U * 8/2022 ..... A47C 4/286
WO WO-2015178837 A1 * 11/2015 ..... A47C 4/286

* cited by examiner

*Primary Examiner* — Anthony D Barfield
(74) *Attorney, Agent, or Firm* — Schmeiser, Olsen & Watts LLP

(57) ABSTRACT

A folding chair is provided including an upper hinge seat, a plurality of support legs, a lower hinge seat and a plurality of upper support rods. Each of the plurality of support legs having an upper end portion rotatable connected to the upper hinge seat and a lower end portion for supporting on the ground, and each of the plurality of upper support rods having a lower end portion rotatably connected to the lower hinge seat. A middle portion of each support leg is rotatably connected with one of the plurality of upper support rods. The upper hinge seat and the lower hinge seat are connected directly or indirectly when the folding chair is in unfolded state, and the upper hinge seat and the lower hinge seat are separated from each other when the folding chair is in folded state.

16 Claims, 9 Drawing Sheets

FOLDING CHAIR

CROSS-REFERENCE TO RELATED APPLICATIONS

This application is a continuation application to PCT Application No. PCT/CN2022/143145, having a filing date of Dec. 29, 2022, which claims priority to CN Application No. 202222837038.7, having a filing date of Oct. 27, 2022, the entire contents both of which are hereby incorporated by reference.

FIELD OF TECHNOLOGY

The following relates to the field of outdoor goods, specifically relates to a folding chair.

BACKGROUND

Folding chairs have the characteristics of folding, easy to carry, and is used in outdoor activities, such as camping and picnics. Folding chairs usually include a folding chair frame, and a cloth cover arranged on the frame, wherein the cloth cover is spread by the frame to support a human body. The chair frame usually includes a plurality of pivoted rods, which can be unfold and fold with respect to each other. However, the existing folding chair structure is complex and costly.

SUMMARY

An aspect relates to an improved folding chair, which makes the structure simple and low cost while ensuring a better structural stability.

A first aspect of the present disclosure provides a folding chair having an unfolded state and a folded state, and comprising:

an upper hinge seat;

a plurality of support legs, each of the plurality of support legs having an upper end portion rotatable connected to the upper hinge seat and a lower end portion for supporting on the ground;

a lower hinge seat, arranged below the upper hinge seat; and a plurality of upper support rods, each of the plurality of upper support rods having a lower end portion rotatably connected to the lower hinge seat;

wherein, a middle portion of each support leg is rotatably connected with one of the plurality of upper support rods; when the folding chair is in the unfolded state, lower end portions of the plurality of support legs are unfolded with respect to each other, upper end portions of the plurality of upper support rods are unfolded with respect to each other, and the upper hinge seat and the lower hinge seat are connected directly or indirectly; when the folding chair is in the folded state, the lower end portions of the plurality of support legs are close to each other, the upper end portions of the plurality of upper support rods are close to each other, and the upper hinge seat and the lower hinge seat are separated from each other.

In an embodiment, when the folding chair is in the unfolded state, the upper hinge seat and the lower hinge seat abut against each other. Wherein, no other intermediate connecting component is arranged between the upper hinge seat and the lower hinge seat, and the upper hinge seat and the lower hinge seat are directly in contact or connected, such as plug-in connected.

In some embodiments, one of the upper hinge seat and the lower hinge seat is provided with an insertion groove, and the other one is provided with an insertion portion; when the folding chair is in the unfolded state, the insertion portion is inserted into the insertion groove; when the folding chair is in the folded state, the insertion portion is separated from the insertion groove.

In some embodiments, a middle portion of the upper hinge seat has a lower extension extending downwards, and the insertion groove is opened on the lower extension; a middle portion of the lower hinge seat has an upper extension extending upwards, and the insertion portion is formed on an upper end portion of the upper extension. When the folding chair is in the unfolded state, the upper hinge seat and the lower hinge seat get close to each other, the upper end portion of the upper extension is gradually inserted into the insertion groove of the lower extension; when the folding chair is folded, the upper hinge seat and the lower hinge seat keep away from each other, and the upper end portion of the upper extension is gradually detached from the insertion groove of the lower extension.

In an embodiment, one of the upper hinge seat and the lower hinge seat is provided with a connection rod, and the other one is detachably connected to the connection rod; when the folding chair is in the unfolded state, the connection rod is connected between the upper hinge seat and the lower hinge seat; when the folding chair is in the folded state, the connection rod is separated from the upper hinge seat or the lower hinge seat.

In an embodiment, the upper hinge seat or the lower hinge seat is provided with an insertion groove into which the connection rod is inserted; when the folding chair is in the unfolded state, an end portion of the connection rod is inserted into the insertion groove; when the folding chair is in the folded state, the connection rod is separated from the insertion groove.

In an embodiment, the lower hinge seat has a plurality of first lower hinge portions and a plurality of second lower hinge portions, the first lower hinge portions are higher than the second lower hinge portions; the plurality of upper support rods comprises front support rods and backrest rods, lower end portions of the front support rods are rotatably connected to the first lower hinge portions, respectively, and lower end portions of the backrest rods are rotatably connected to the second lower hinge portions, respectively. Wherein, the first lower hinge portions and the second lower hinge portions are arranged in a high-low staggered manner (the first lower hinge portions are higher than the second lower hinge portions), and the backrest rods have a smaller tilt angle (i.e., closer to a vertical plane), thus providing better support for the user's back; the front support rods have a larger tilt angle (i.e., closer to a horizontal plane), and the spacing between the front support rods and the backrest rods is increased; while ensuring easy folding and a smaller volume after folding, it is ergonomic and improves the comfort of use. To solve the following defects in the existing folding chair: limited by the folded volume requirements of the chair frame, the angle of the backrest rods is not set reasonably enough, the comfort is poor.

In an embodiment, an angle between each of the front support rods and a horizontal plane is less than an angle between each of the backrest rods and the horizontal plane.

In an embodiment, the plurality of support legs and the plurality of upper support rods are staggered; only one first lower hinge portion or one second lower hinge portion is arranged between two adjacent support legs.

In an embodiment, the upper hinge seat comprises a plurality of upper hinge portions radially extending outwards, and the plurality of upper hinge portions is spaced along a circumferential direction of the upper hinge seat.

In an embodiment, the upper hinge portions are hinge slots, and the hinge slots have lower sides and outer sides that are open arranged.

In an embodiment, in a top view, each of the first lower hinge portions or each of the second lower hinge portions is located between two adjacent upper hinge portions.

In an embodiment, a pattern formed by orthographic projections of the plurality of the upper hinge portions on the horizontal plane is axisymmetric, and a pattern formed by orthographic projections of the first lower hinge portions and the second lower hinge portions on the horizontal plane is centrosymmetric and not axisymmetric.

In an embodiment, a lower end portion of each support leg is provided with a foot pad, the foot pad has a support surface, and when the folding chair is in the unfolded state, the support surface of each foot pad is in the same plane.

In an embodiment, each upper support rod has a connection sleeve, and the connection sleeve is rotatably connected to one of the support legs.

In an embodiment, the front support rods, the backrest rods or the support legs are telescopic rods.

In an embodiment, the first lower hinge portions and/or the second lower hinge portions are hinge slots, and the hinge slots have upper sides and outer sides that are open arranged.

When the folding chair of the present disclosure is unfolded, the upper hinge seat and the lower hinge seat are directly or indirectly connected, and the upper hinge seat and the lower hinge seat are separated from each other when folded, which simplifies the structure and makes the cost lower under the premise of ensuring a better structural stability of the folding chair after unfolding.

BRIEF DESCRIPTION

Some of the embodiments will be described in detail, with references to the following Figures, wherein like designations denote like members, wherein.

REFERENCE NUMBERS

11—upper hinge seat; 111—upper hinge portion; 12—support leg; 121—upper end portion; 13—lower hinge seat; 131—first lower hinge portion; 132—second lower hinge portion; 133—insertion groove; 14—upper support rod; 141—front support rod; 142—backrest rod; 143—connection sleeve; 15—rod; 16—connection rod; 17—foot pad; 171—support surface.

DETAILED DESCRIPTION

In the following, the embodiments of the present disclosure are explained in detail combining with the accompanying drawings so that the advantages and features of the present disclosure can be easily understood by the skilled persons in the conventional art. It should be noted that the explanation on these implementations is to help understanding of the present disclosure, and is not intended to limit the present disclosure. Further, the technical features involved in the various embodiments of the present disclosure described below may be combined with each other if they do not conflict with each other.

Embodiment 1

Figure 1:
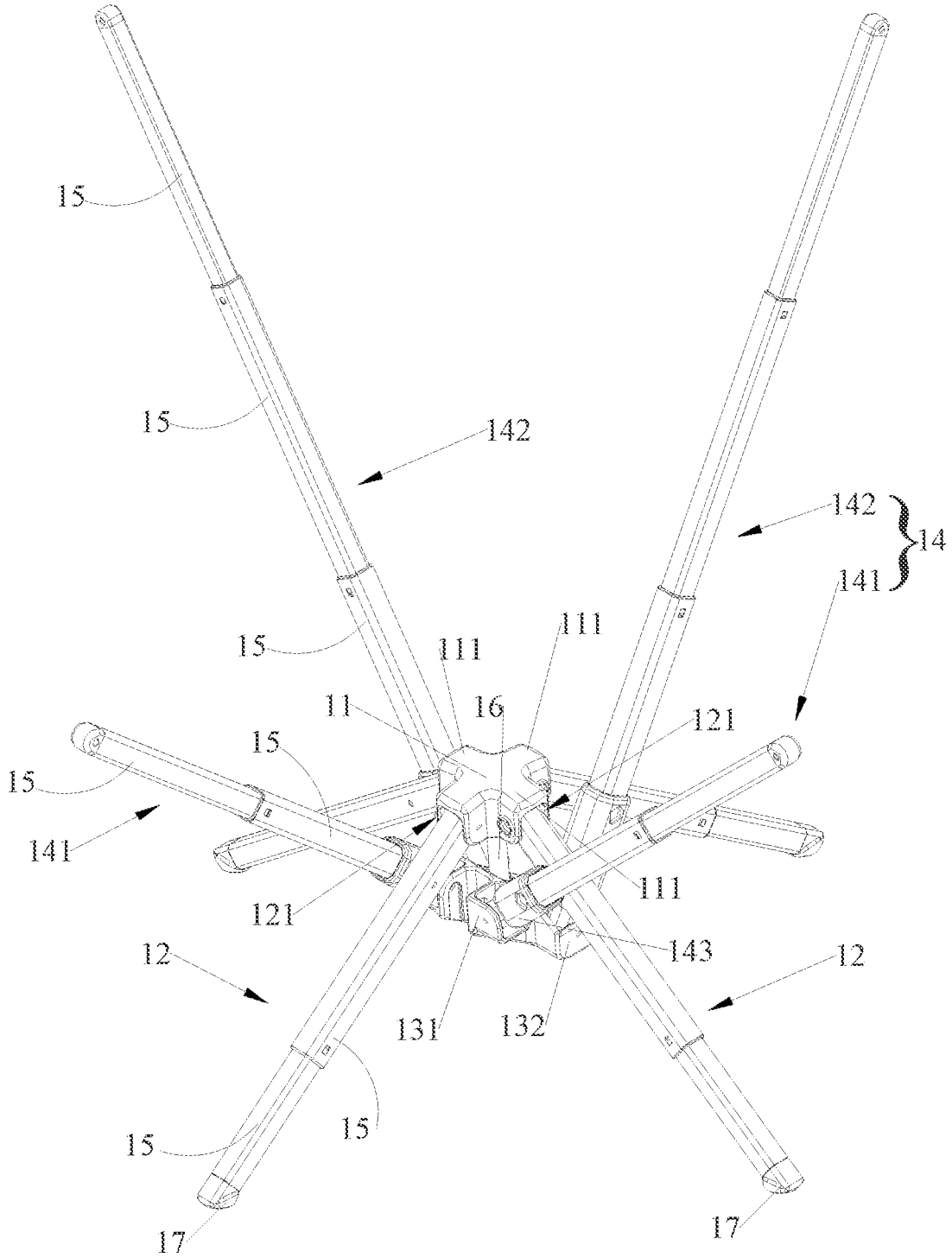
FIG. 1 shows a three-dimensional diagram of a folding chair according to Embodiment 1 of the present disclosure in the unfolded state, wherein the front support rods, the backrest rods and the support legs are not retracted.
Figure 3:
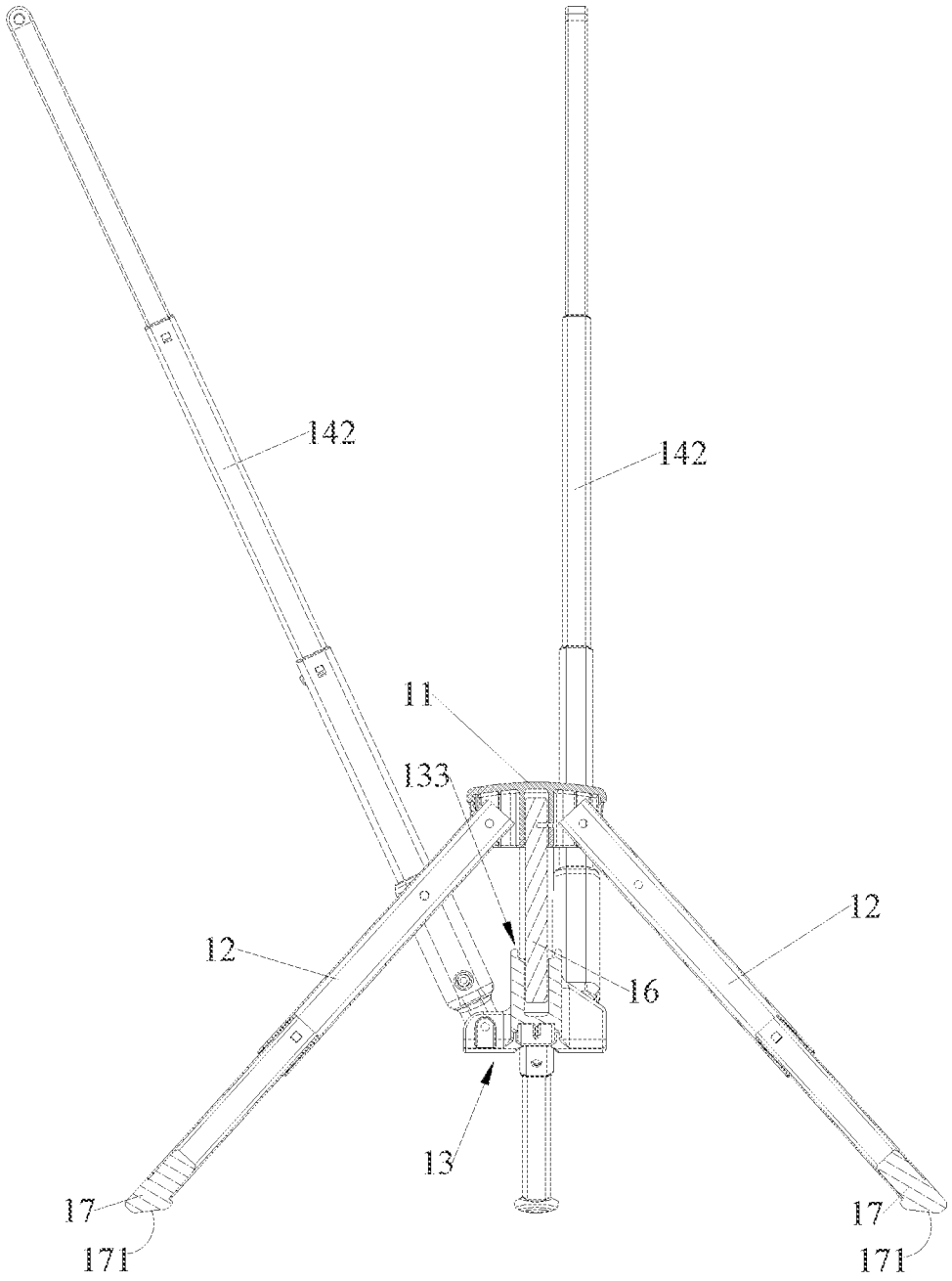
FIG. 3 shows a section view of a folding chair according to Embodiment 1 of the present disclosure in the unfolded state.
Figure 4:
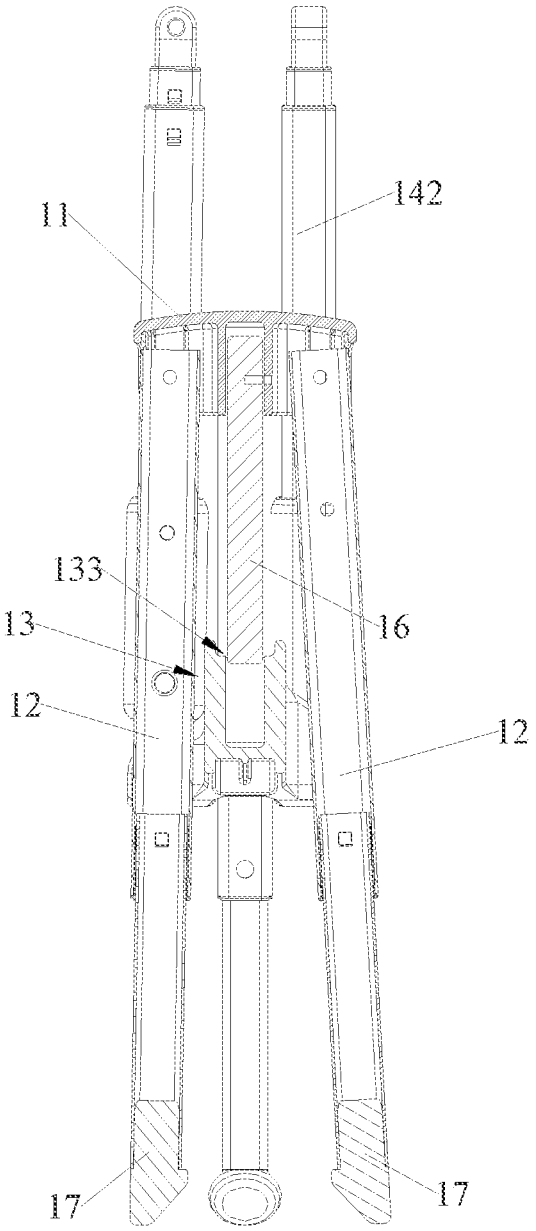
FIG. 4 shows a section view of a folding chair according to Embodiment 1 of the present disclosure in the folded state, wherein the support legs are not retracted.
Figure 5:
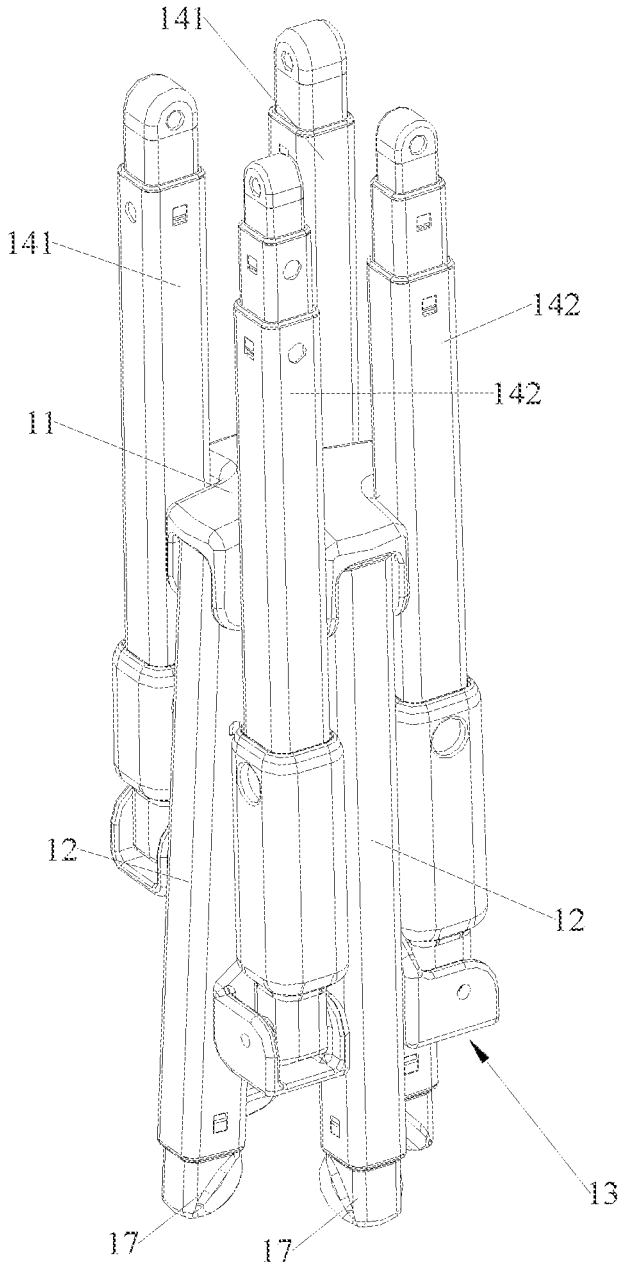
FIG. 5 shows a three-dimensional diagram of a folding chair according to Embodiment 1 of the present disclosure in the folded state.
Figure 6:
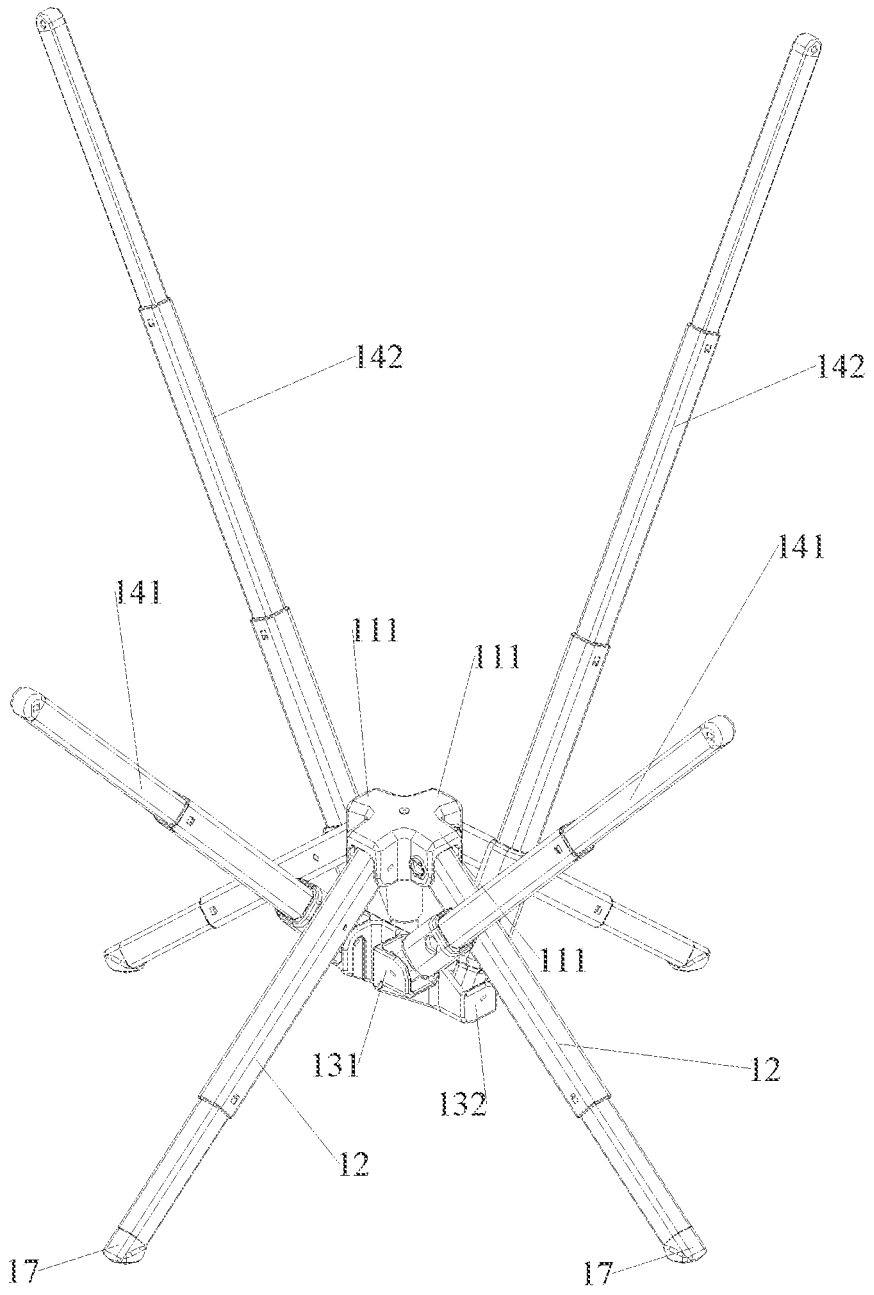
FIG. 6 shows a three-dimensional diagram of a folding chair according to Embodiment 2 of the present disclosure in the unfolded state, wherein the front support rods, the backrest rods and the support legs are not retracted.
Figure 7:
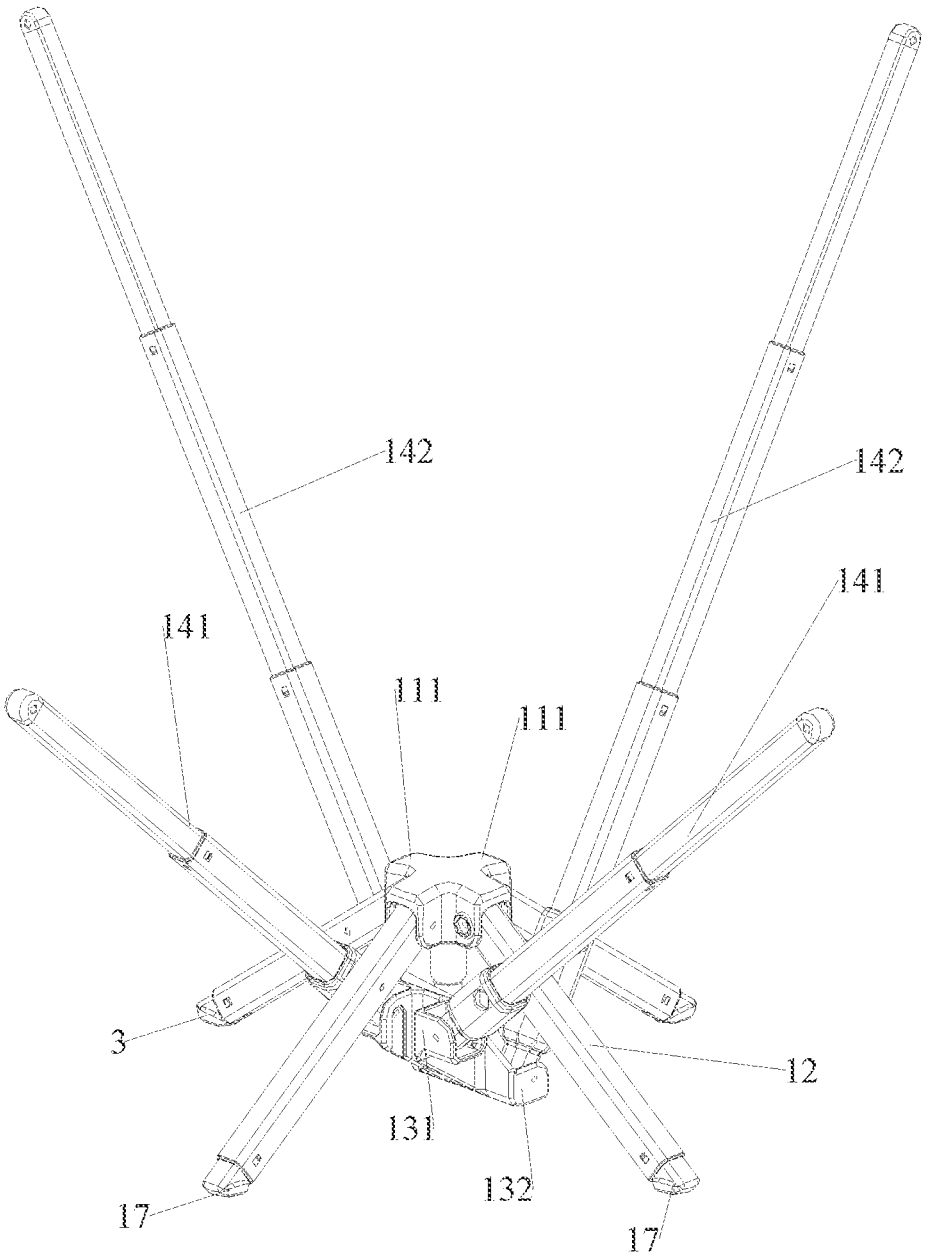
FIG. 7 shows a three-dimensional diagram of a folding chair according to Embodiment 2 of the present disclosure in the unfolded state, wherein the front support rods, the backrest rods and the support legs are retracted.

Referring to FIG. 1 to FIG. 5, this embodiment provides an outdoor folding chair having an unfolded state as shown in FIG. 1 and a folded state as shown in FIG. 5. The folding chair comprises an upper hinge seat 11, a plurality of support legs 12, a lower hinge seat 13, and a plurality of upper support rods 14. The folding chair further comprises a support fabric cover, which is connected to the plurality of upper support rods 14 to form a seat portion to support a hip of a user, and may further form a backrest portion to support a back of a user. When the folding chair is in the unfolded state, the fabric cover is spread by the plurality of upper support rods 14 to support a human body.

Further, the upper hinge seat 11 comprises a plurality of upper hinge portions 111 radially extending outwards, and the plurality of upper hinge portions 111 is spaced along the circumferential direction of the upper hinge seat 11. Each support leg 12 has an upper end portion 121 rotatable connected to the upper hinge seat 11 and a lower end portion for supporting on the ground. The upper hinge portions 111 are specifically hinge slots, and the hinge slots have open lower sides and open outer sides; wherein, the upper end portions 121 of the support legs 12 are inserted into and hinged with the hinge slots. Here, the orientation term "outer side" is defined with reference to the geometric center of the upper hinge seat 11, with the side further away from the geometric center of the upper hinge seat 11 being the outer side.

The lower hinge seat 13 is arranged below the upper hinge seat 11, and the upper hinge seat 11 and the lower hinge seat 13 may be directly connected or indirectly connected; in this embodiment, the upper hinge seat 11 is indirectly connected to the lower hinge seat 13 via a connection rod 16 described below. Each upper support rod 14 has a lower end portion rotatably connected to the lower hinge seat 13. The lower hinge portions 13 are specifically hinge slots, and the hinge slots have open upper sides and open outer sides, to be hinged with the upper support rods 14; wherein, the lower end portions of the upper support rods 12 are inserted into and hinged with the hinge slots. Here, the orientation term "outer side" is defined with reference to the geometric center of the lower hinge seat 13, with the side further away from the geometric center of the lower hinge seat 13 being the outer side.

The middle portion of each support leg 13 is further rotatably connected with one corresponding upper support rod 14, and the plurality of support legs 12 and the plurality of upper support rods 14 are arranged in a staggered manner. Specifically, each upper support rod 14 has a connection sleeve 143, and the connection sleeve 143 is rotatably connected to one corresponding support leg 12.

Figure 2:
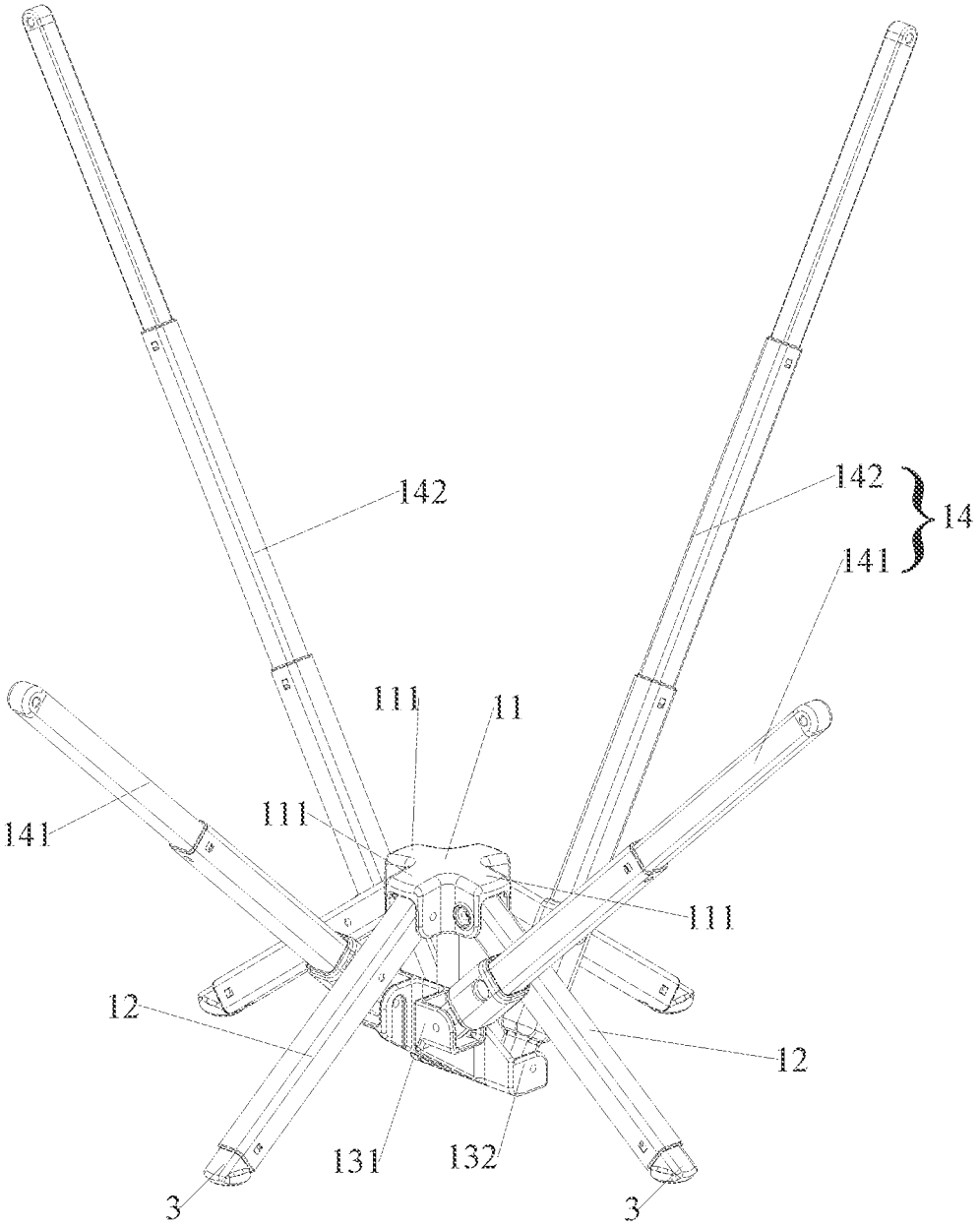
FIG. 2 shows a three-dimensional diagram of a folding chair according to Embodiment 1 of the present disclosure in the unfolded state, wherein the front support rods, the backrest rods and the support legs are retracted.

More further, referring to FIG. 1 and FIG. 2, the lower hinge seat 13 has first lower hinge portions 131 and second lower hinge portions 132, the first lower hinge portions 131 are higher than the second lower hinge portions 132, only one first lower hinge portion 131 or one second lower hinge portion 132 is arranged between two adjacent support legs 12, and in a top view, each of the first lower hinge portions 131 or each of the second lower hinge portions 132 is located between two adjacent upper hinge portions 111.

The plurality of upper support rods 14 comprises two front support rods 141 and two backrest rods 142, a lower end portion of each front support rod 141 is rotatably connected to one corresponding first lower hinge portion 131, and a lower end portion of the backrest rod 142 is rotatably connected to one corresponding second lower hinge portion 132, which makes the inclination of the front support rods 141 less than the inclination of the backrest rods 142, which is more ergonomic and more comfortable when using the folding chair.

It should also be noted that, an upper receiving slot is formed between any two adjacent upper hinge portions 111, and when the folding chair is in the folded state, the upper support rods 14 are close to the upper hinge seat 11 and is received in the upper receiving slots; similarly, there are lower receiving slots formed between adjacent first lower hinge portions 131, between adjacent second lower hinge portions 132, and between the first lower hinge portions 131 and the second lower hinge portions 132, and when the folding chair is in the folded state, the support legs 12 are close to the upper hinge seat 11 and are received in the lower receiving slots. In addition, "rotatably connected" mentioned above is specifically pivotally connected.

A lower end portion of each support leg 12 is provided with a foot pad 17, the foot pad 17 has a support surface 171, and when the folding chair is in the unfolded state, the support surface 171 of each foot pad 17 is in the same plane.

Each front support rod 141, backrest rod 142 or support leg 12 is a telescopic rod. Specifically, referring to FIG. 1, each front support rod 141 comprises two rods 15 that are sleeved together and can be retracted relative to each other, each backrest rod 142 comprises three rods 15 that are sleeved together and can be retracted relative to each other, and the support leg 12 comprises two rods 15 that are sleeved together and can be retracted relative to each other, so that the height of the folding chair can be adaptively adjusted, and after being folded, the size is smaller.

Referring to FIG. 3 and FIG. 4, one of the upper hinge seat 11 and the lower hinge seat 13 is provided with a connection rod 16, and the other one is detachably connected to the connection rod 16. Specifically in this embodiment, the upper hinge seat 11 is provided with a connection rod 16, and the lower hinge seat 13 is detachably connected to the connection rod 16. The upper hinge seat 11 or the lower hinge seat 13 is provided with an insertion groove 133 into which the connection rod 16 is inserted, and specifically in this embodiment, the lower hinge seat 13 is provided with the insertion groove 133, and the lower end portion of the connection rod 16 is detachably inserted into the insertion groove 133.

When the folding chair is in the unfolded state, the lower end portions of the plurality of support legs 12 are relatively folded, the upper end portions of the plurality of upper support rods 14 are relatively folded, and the connection rod 16 is connected between the upper hinge seat 11 and the lower hinge seat 13; specifically, the lower end portion of the connection rod 16 is inserted in the insertion groove 133 of the lower hinge seat 13. When the folding chair is in the folded state, the lower end portions of the plurality of support legs 12 get closer to each other, the upper end portions of the plurality of upper support rods 14 get closer to each other, the connection rod 16 is detached from the lower hinge seat 13, and the upper hinge seat 11 and the lower hinge seat 13 are separated from each other; specifically, the lower end portion of the connection rod 16 is detached from the insertion groove 133 of the lower hinge seat 13.

In this embodiment, there are four support legs 12 and four support rods 14, both upper support rods 14 and support legs 12 comprise rods 15 that are sleeved together and can be retracted relative to each other, and the volume of the folding chair after being retracted and folded is small, which reduces the size of the package; by providing the upper hinge seat 11 and lower hinge seat 13 in the center of the folding chair, the support legs 12 and the upper support rods 14 are connected respectively, and the plurality of support legs 12 and the plurality of upper support rods 14 are arranged in a staggered manner, i.e., one upper support rod 14 is received between each two support legs 12, which makes reasonable use of space and the size small after folding; the upper hinge seat 11 is provided with a connection rod 16, and the lower hinge seat 13 is detachably connected to the connection rod 16, and when in the unfolded state, the connection rod 16 is connected between the upper hinge seat 11 and the lower hinge seat 13, with a good structural stability; the first lower hinge portions and the second lower hinge portions are arranged in a high-low staggered manner, the backrest rods have a smaller tilt angle (i.e., closer to a vertical plane), thus providing better support for the user's back; the front support rods have a larger tilt angle (i.e., closer to a horizontal plane), and the spacing between the front support rods and the backrest rods is increased, improving the comfort of use.

The folding chair of this embodiment is simple in structure and low in cost, and when in the unfolded state, the lower end portions of the plurality of support legs 12 are relatively unfolded, the upper end portions of the plurality of upper support rods 14 are relatively unfolded, the connection rod 16 is connected between the upper hinge seat 11 and the lower hinge seat 13, and when the folding chair turns from the unfolded state to the folded state, the upper hinge seat 11 is pulled upwards, the support legs 12 and the upper support rods 14 are then turned over (as shown in FIG. 4), then rods 15 of the respective support legs 12 and the respective upper support rods 14 are retracted to the state as shown in FIG. 5, with a smaller volume after folding.

Embodiment 2

Figure 8:
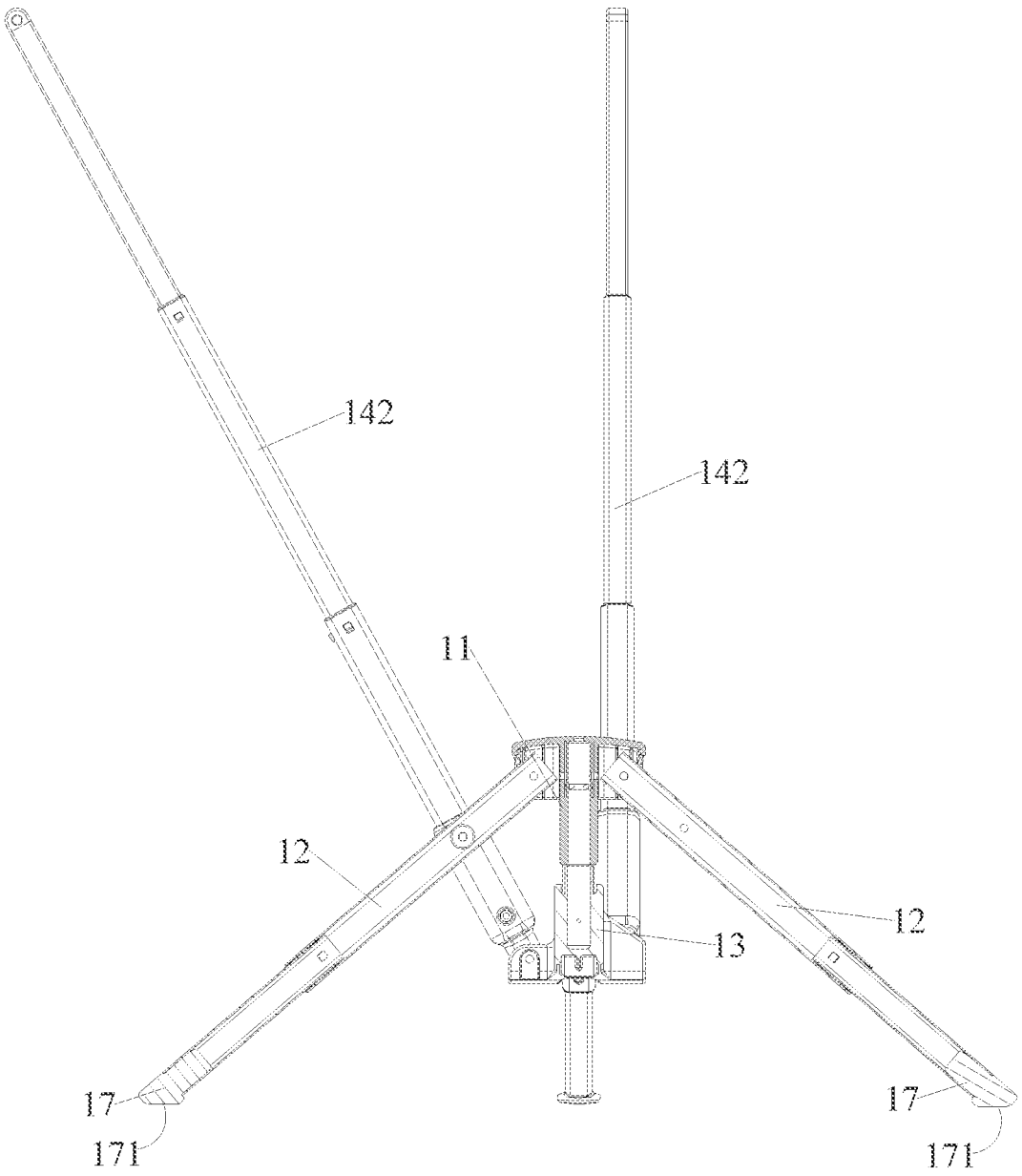
FIG. 8 shows a section view of a folding chair according to Embodiment 2 of the present disclosure in the unfolded state.
Figure 9:
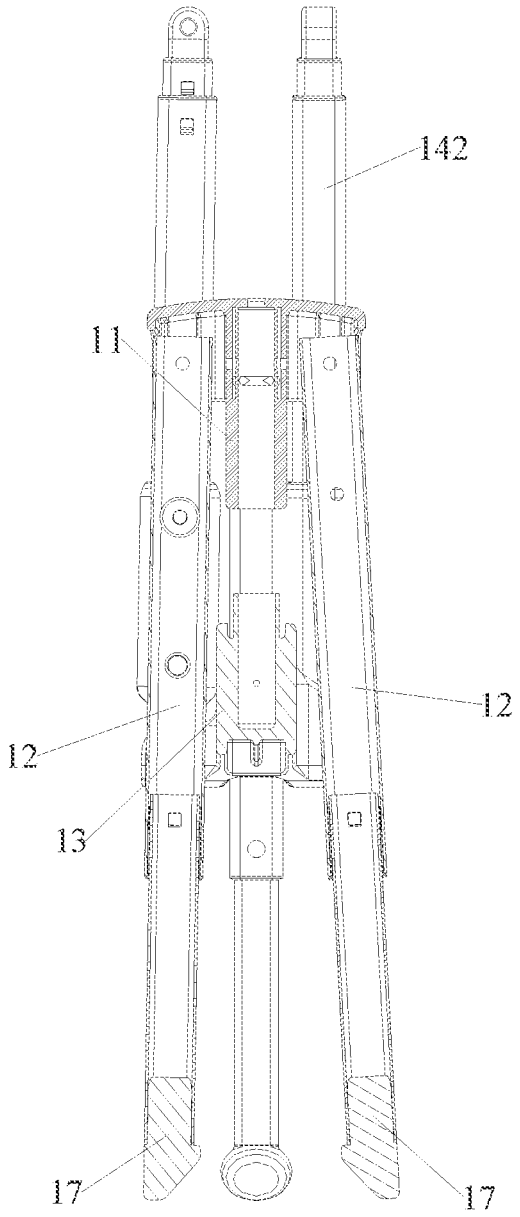
FIG. 9 shows a section view of a folding chair according to Embodiment 2 of the present disclosure in the folded state, wherein the support legs are not retracted.

Referring to FIGS. 6 to 9, the difference between this embodiment and Embodiment 1 is that the upper hinge seat 11 and the lower hinge seat 13 are not directly connected to each other by any rod, and the rest is basically the same as Embodiment 1. Referring to FIGS. 6 to 9, the middle portion of the upper hinge seat 11 extends downwards, the middle portion of the lower hinge seat 13 extends upwards, and there are no other connecting parts between the upper hinge seat 11 and the lower hinge seat 13 other than the plurality of upper support rods 14 and the plurality of support legs 12. When the folding chair is in the unfolded state as shown in FIG. 8, the upper hinge seat 11 and the lower hinge seat 13 abut against each other, specifically, the upper hinge seat 11 and the lower hinge seat 13 abut against each other; when the folding chair is in the folded state as shown in FIG. 9, the upper hinge seat 11 and the lower hinge seat 13 are separated from each other.

The middle portion of the upper hinge seat 11 has a lower extension extending downwards, and an insertion groove is opened on the lower extension. The middle portion of the lower hinge seat 13 has an upper extension extending upwards, and an insertion portion is formed on an upper end portion of the upper extension. When the folding chair is in the unfolded state, the upper hinge seat 11 and the lower hinge seat 13 get close to each other, the upper end portion of the upper extension is gradually inserted into the insertion groove of the lower extension; when the folding chair is folded, the upper hinge seat 11 and the lower hinge seat 13 keep away from each other, and the upper end portion of the upper extension is gradually detached from the insertion groove of the lower extension. The height of the upper extension, the height of the lower extension, or the sum of the two is less than the length of the upper support rods 14 or the support legs 12 after retraction.

As shown in the description and the claims, the terms "comprising" and "including" only indicate that the clearly identified steps and elements are included, and these steps and elements do not constitute an exclusive list, and embodiments of the method or device may further include other steps or elements. The term "and/or" as used herein includes any combination of one or more of the associated listed items.

Unless otherwise expressly described in the context, the indefinite article "one", "a", and "an" preceding an element or component herein is intended to be a non-limiting indication of the number of instances (i.e., occurrences) of the element or component. Thus, "one", "a" and "an" are understood to include one or at least one, and include the singular form and the plural form of the element or component.

It should be noted that, unless otherwise specified, when a feature is called "arranged" or "connected" to another feature, it can be directly arranged or connected to another feature, or it can be indirectly arranged or connected to another feature. In addition, the descriptions of top, bottom, left, right, etc., as used in the present disclosure are only relative to the positional relationship of the components of the present disclosure in the accompanying drawings.

It is further understood that the terms "first", "second", etc. are used to describe a variety of information, but such information should not be limited to these terms. These terms are used only to distinguish the same type of information from one another and do not indicate a particular order or level of importance. In fact, the expressions "first" and "second" can be used interchangeably. For example, without departing from the scope of this disclosure, the first information may also be referred to as the second information, and similarly, the second information may also be referred to as the first information.

Although the present invention has been disclosed in the form of embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

The invention claimed is:

1. A folding chair having an unfold state and a folded state, comprising:

an upper hinge seat; a plurality of support legs, each of the plurality of support legs having an upper end portion rotatably connected to the upper hinge seat, and a lower end portion for supporting on a ground; a lower hinge seat, arranged below the upper hinge seat; a plurality of upper support rods, each of the plurality of upper support rods having a lower end portion rotatably connected to the lower hinge seat; and wherein, a middle portion of each support leg is rotatably connected with one of the plurality of upper support rods;

wherein, when the folding chair is in the unfolded state, the lower end portions of the plurality of support legs are unfolded with respect to each other, the upper end portions of the plurality of upper support rods are unfolded with respect to each other, and the upper hinge seat and the lower hinge seat are connected directly or indirectly;

wherein, when the folding chair is in the folded state, the lower end portions of the plurality of support legs are close to each other, the upper end portions of the plurality of upper support rods are close to each other, and the upper hinge seat and the lower hinge seat are separated from each other.

2. The folding chair according to claim 1, wherein, when the folding chair is in the unfolded state, the upper hinge seat and the lower hinge seat abut against each other.

3. The folding chair according to claim 2, wherein one of the upper hinge seat and the lower hinge seat is provided with an insertion groove, and the other one is provided with an insertion portion; when the folding chair is in the unfolded state, the insertion portion is inserted into the insertion groove, and, when the folding chair is in the folded state, the insertion portion is separated from the insertion groove.

4. The folding chair according to claim 3, wherein a middle portion of the upper hinge seat has a lower extension extending downwards, and the insertion groove is opened on the lower extension; a middle portion of the lower hinge seat has an upper extension extending upwards, and the insertion portion is formed on an upper end portion of the upper extension.

5. The folding chair according to claim 1, wherein one of the upper hinge seat and the lower hinge seat is provided with a connection rod, and the other one is detachably connected to the connection rod; when the folding chair is in the unfolded state, the connection rod is connected between the upper hinge seat and the lower hinge seat, and when the folding chair is in the folded state, the connection rod is separated from the upper hinge seat or the lower hinge seat.

6. The folding chair according to claim 5, wherein the upper hinge seat or the lower hinge seat is provided with an insertion groove into which the connection rod is inserted; when the folding chair is in the unfolded state, an end portion of the connection rod is inserted into the insertion groove, and, when the folding chair is in the folded state, the connection rod is separated from the insertion groove.

7. The folding chair according to claim 1, wherein the lower hinge seat has a plurality of first lower hinge portions and a plurality of second lower hinge portions, the plurality of first lower hinge portions are higher than the plurality of second lower hinge portions; the plurality of upper support rods comprises front support rods and backrest rods, lower end portions of the front support rods are rotatably connected to the plurality of first lower hinge portions, respectively, and lower end portions of the backrest rods are rotatably connected to the plurality of second lower hinge portions, respectively.

8. The folding chair according to claim 7, wherein an angle between each of the front support rods and a horizontal plane is less than an angle between each of the backrest rods and the horizontal plane.

9. The folding chair according to claim 7, wherein the plurality of support legs and the plurality of upper support rods are staggered, and only one of the plurality of first lower hinge portions or one of the plurality of second lower hinge portions is arranged between two adjacent support legs.

10. The folding chair according to claim 9, wherein the upper hinge seat comprises a plurality of upper hinge portions radially extending outwards, and the plurality of upper hinge portions is spaced along a circumferential direction of the upper hinge seat; in a top view, each of the first lower hinge portions or each of the second lower hinge portions is located between two adjacent upper hinge portions.

11. The folding chair according to claim 10, wherein a pattern formed by orthographic projections of the plurality of the upper hinge portions on a horizontal plane is axisymmetric, and a pattern formed by orthographic projections of the plurality of first lower hinge portions and the plurality of second lower hinge portions on the horizontal plane is centrosymmetric and not axisymmetric.

12. The folding chair according to claim 10, wherein the upper hinge portions are hinge slots, and the hinge slots have lower sides and outer sides that are open arranged.

13. The folding chair according to claim 7, wherein a lower end portion of each support leg is provided with a foot pad, the foot pad has a support surface, and when the folding chair is in the unfolded state, the support surface of each foot pad is in the same plane.

14. The folding chair according to claim 7, wherein each upper support rod has a connection sleeve, and the connection sleeve is rotatably connected to one of the corresponding support legs.

15. The folding chair according to claim 7, wherein the front support rods, the backrest rods, or the support legs are telescopic rods.

16. The folding chair according to claim 7, wherein the plurality of first lower hinge portions and/or the plurality of second lower hinge portions are hinge slots, and the hinge slots have upper sides and outer sides that are open arranged.

* * * * *